US012503211B2

(12) United States Patent
Saruwatari et al.

(10) Patent No.: US 12,503,211 B2
(45) Date of Patent: Dec. 23, 2025

(54) OUTBOARD MOTOR AND MARINE VESSEL

(71) Applicant: YAMAHA HATSUDOKI KABUSHIKI KAISHA, Iwata (JP)

(72) Inventors: Kimitaka Saruwatari, Shizuoka (JP); Yuhei Suzuki, Shizuoka (JP); Akira Harabe, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 835 days.

(21) Appl. No.: 17/861,332

(22) Filed: Jul. 11, 2022

(65) Prior Publication Data

US 2023/0026711 A1 Jan. 26, 2023

(30) Foreign Application Priority Data

Jul. 21, 2021 (JP) ..... 2021-120666

(51) Int. Cl.
*B63H 20/12* (2006.01)
*B63H 20/20* (2006.01)
*B63H 21/21* (2006.01)

(52) U.S. Cl.
CPC ..... *B63H 20/12* (2013.01); *B63H 20/20* (2013.01); *B63H 21/213* (2013.01)

(58) Field of Classification Search
CPC ..... B63H 20/12; B63H 20/20; B63H 21/213
See application file for complete search history.

(56) References Cited

U.S. PATENT DOCUMENTS 5,050,461 A * 9/1991 Onoue ..... B63H 20/20 440/86
6,238,255 B1 * 5/2001 Takase ..... B63H 21/213 440/86
2008/0015747 A1 * 1/2008 Hiroshima ..... F02D 11/105 701/21
2008/0201031 A1 * 8/2008 Ito ..... B63H 21/213 701/21
2023/0026711 A1 * 1/2023 Saruwatari ..... B63H 20/12

FOREIGN PATENT DOCUMENTS

JP 02-216391 A 8/1990
JP 2000-085688 A 3/2000
JP 2008-018882 A 1/2008

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

An outboard motor includes a shift actuator, a wire connector to allow a wire of a mechanical remote control to be connected thereto and operable to be moved by the wire, a shift detector to detect that the wire connector has moved to a neutral position corresponding to a shift state of a neutral state or a drive position corresponding to the shift state of a drive state, and a controller configured or programmed to perform a control to drive the shift actuator to switch the shift state to the neutral state or the drive state based on a detection result of the shift detector.

20 Claims, 4 Drawing Sheets

OUTBOARD MOTOR AND MARINE VESSEL

CROSS REFERENCE TO RELATED APPLICATIONS

This application claims the benefit of priority to Japanese Patent Application No. 2021-120666 filed on Jul. 21, 2021. The entire contents of this application are hereby incorporated herein by reference.

BACKGROUND OF THE INVENTION

1. Field of the Invention

The present invention relates to an outboard motor of which the shift state is switched based on an operation on a mechanical remote control, and a marine vessel of which the shift state is switched based on an operation on a mechanical remote control.

2. Description of the Related Art

A marine vessel of which the shift state is switched based on an operation on a mechanical remote control is known in general. Such a marine vessel is disclosed in Japanese Patent Laid-Open No. 2008-018882, for example.

Japanese Patent Laid-Open No. 2008-018882 discloses a marine vessel including a hull, a mechanical shift/throttle lever (mechanical remote control), and an outboard motor of which the shift state is switched based on an operation on the mechanical shift/throttle lever. The outboard motor described in Japanese Patent Laid-Open No. 2008-018882 is a shift-by-wire outboard motor including an ECU that acquires a digital signal (electrical signal) to switch the shift state of the outboard motor. Therefore, in the hull on which the outboard motor is installed, a hull-side conversion unit is provided to output a digital signal (electrical signal) to the ECU of the outboard motor in response to movement of a wire connected to the mechanical shift/throttle lever based on the operation on the mechanical shift/throttle lever.

However, in the marine vessel described in Japanese Patent Laid-Open No. 2008-018882, it is necessary to provide the hull-side conversion unit in the hull to output a digital signal (electrical signal) to the ECU of the outboard motor in response to movement of the wire connected to the mechanical shift/throttle lever in order to operate the shift-by-wire outboard motor with the mechanical shift/throttle lever.

SUMMARY OF THE INVENTION

Preferred embodiments of the present invention provide outboard motors and marine vessels that each enable shift-by-wire outboard motors to be operated with mechanical remote controls without providing devices in hulls to output electrical signals to controllers of the outboard motors in response to movement of wires connected to the mechanical remote controls.

An outboard motor according to a preferred embodiment of the present invention includes a shift actuator to drive a shift shaft to switch a shift state of the outboard motor, a wire connector to allow a wire of a mechanical remote control to be connected thereto and operable to be moved by the wire, a shift detector to detect that the wire connector has moved to a neutral position corresponding to the shift state of a neutral state or a drive position corresponding to the shift state of a drive state, and a controller configured or programmed to perform a control to drive the shift actuator to switch the shift state to the neutral state or the drive state based on a detection result of the shift detector.

An outboard motor according to a preferred embodiment of the present invention includes the shift detector to detect that the wire connector to which the wire of the mechanical remote control is connected and that is moved by the wire has moved to the neutral position corresponding to the shift state of the neutral state or the drive position corresponding to the shift state of the drive state, and the controller configured or programmed to perform a control to drive the shift actuator to switch the shift state to the neutral state or the drive state based on the detection result of the shift detector. Accordingly, the controller uses the wire connector and the shift detector, which are elements of the outboard motor, to detect movement of the wire connector to the neutral position or the drive position in response to movement of the wire connected to the mechanical remote control so as to acquire the detection result (electrical signal) to switch the shift state to the neutral state or the drive state. Therefore, the wire of the mechanical remote control is directly connected to the outboard motor. That is, the shift-by-wire outboard motor is operated by the mechanical remote control without providing, on a hull, a device that outputs an electrical signal to the controller of the outboard motor in response to movement of the wire connected to the mechanical remote control.

In an outboard motor according to a preferred embodiment of the present invention, the shift detector preferably includes a neutral position detector to detect that the wire connector is located at the neutral position, and a drive position detector to detect that the wire connector is located at the drive position. Accordingly, each of the neutral position and the drive position is detected by the dedicated detector, and thus it is accurately detected that the wire connector is located at the neutral position or the drive position.

In such a case, an outboard motor according to a preferred embodiment of the present invention preferably further includes a guide to guide the wire connector between the neutral position and the drive position and slide the wire connector. Accordingly, the guide easily converts a force applied from the wire to the wire connector into sliding of the wire connector.

In an outboard motor including the guide, the wire connector, the shift detector, and the guide are preferably provided in or on a common bracket. Accordingly, the common bracket eliminates the need to individually attach the wire connector, the shift detector, and the guide to the outboard motor, and the wire connector, the shift detector, and the guide are easily attached.

In an outboard motor including the guide, the drive position detector preferably includes a forward drive position detector to detect that the wire connector is located at a forward drive position, and a reverse drive position detector to detect that the wire connector is located at a reverse drive position. Furthermore, the neutral position detector is preferably provided in a vicinity of or adjacent to a center position of the guide corresponding to the neutral position, the forward drive position detector is preferably provided in a vicinity of or adjacent to a position on a first end side of the guide corresponding to the forward drive position, and the reverse drive position detector is preferably provided in a vicinity of or adjacent to a position on a second end side of the guide corresponding to the reverse drive position. Accordingly, the forward drive position detector, the reverse drive position detector, and the neutral position detector are provided at the positions of the guide that slides the wire connector, respectively, such that the shift state is switchable to the neutral state, the forward drive state, or the reverse drive state based on an operation on the mechanical remote control.

In an outboard motor including the shift detector that includes the neutral position detector and the drive position detector, the neutral position detector preferably includes a neutral switch and is preferably operable to detect that the wire connector is located at the neutral position by pressing of the neutral switch by the wire connector that has moved to the neutral position, and the drive position detector preferably includes a drive switch and is preferably operable to detect that the wire connector is located at the drive position by pressing of the drive switch by the wire connector that has moved to the drive position. Accordingly, the switch-type neutral position detector and drive position detector easily detect that the wire connector is located at the neutral position and the drive position.

An outboard motor according to a preferred embodiment of the present invention preferably further includes a cowling in an upper portion of an outboard motor main body, and the wire connector and the shift detector are preferably housed together with the controller inside the cowling. Accordingly, the wire connector, the shift detector, and the controller are located in the upper portion of the outboard motor main body that a service worker can reach relatively easily, and thus the mechanical remote control, the wire connector, the shift detector, and the controller are easily connected to each other.

In such a case, an outboard motor according to a preferred embodiment of the present invention preferably further includes an engine housed inside the cowling, and the controller preferably includes an engine control unit configured or programmed to control driving of the engine. Accordingly, as compared with a case in which the controller is separate from the engine control unit, the device structure is simplified.

In an outboard motor according to a preferred embodiment of the present invention, the wire connector is preferably provided independently of the shift actuator and the shift shaft without being mechanically connected to the shift actuator and the shift shaft. Accordingly, the shift-by-wire outboard motor is operated by the mechanical remote control without a conventional link mechanism that mechanically connects the wire connector to the shift actuator or the shift shaft.

In an outboard motor according to a preferred embodiment of the present invention, the shift actuator preferably includes an electric motor drivingly controlled by the controller. Accordingly, the shift shaft is driven by the electric motor drivingly controlled by the engine control unit.

An outboard motor according to a preferred embodiment of the present invention preferably further includes a cowling in an upper portion of an outboard motor main body, a lower case in a lower portion of the outboard motor main body, and an upper case between the cowling and the lower case, and the shift actuator is preferably provided in the lower case. Accordingly, even when the shift actuator is provided in the lower case, the shift-by-wire outboard motor is operated by the mechanical remote control without providing, on the hull, a device that converts a driving force generated by the wire pulled by the mechanical remote control into an electrical signal.

A marine vessel according to a preferred embodiment of the present invention includes a hull including a mechanical remote control, and an outboard motor mounted on the hull. The outboard motor includes a shift actuator to drive a shift shaft to switch a shift state of the outboard motor, a wire connector to allow a wire of the mechanical remote control to be connected thereto and operable to be moved by the wire, a shift detector to detect that the wire connector has moved to a neutral position corresponding to the shift state of a neutral state or a drive position corresponding to the shift state of a drive state, and a controller configured or programmed to perform a control to drive the shift actuator to switch the shift state to the neutral state or the drive state based on a detection result of the shift detector.

A marine vessel according to a preferred embodiment of the present invention includes the shift detector to detect that the wire connector to which the wire of the mechanical remote control is connected and that is moved by the wire has moved to the neutral position corresponding to the shift state of the neutral state or the drive position corresponding to the shift state of the drive state, and the controller configured or programmed to perform a control to drive the shift actuator to switch the shift state to the neutral state or the drive state based on the detection result of the shift detector. Accordingly, the shift-by-wire outboard motor of the marine vessel is operated by the mechanical remote control without providing, on the hull, a device that outputs an electrical signal to the controller of the outboard motor in response to movement of the wire connected to the mechanical remote control.

In a marine vessel according to a preferred embodiment of the present invention, the shift detector preferably includes a neutral position detector to detect that the wire connector is located at the neutral position, and a drive position detector to detect that the wire connector is located at the drive position. Accordingly, each of the neutral position and the drive position is detected by the dedicated detector, and thus it is accurately detected that the wire connector is located at the neutral position or the drive position.

In such a case, the outboard motor preferably further includes a guide to guide the wire connector between the neutral position and the drive position and slide the wire connector. Accordingly, the guide easily converts a force applied from the wire to the wire connector into sliding of the wire connector.

In a marine vessel including the guide, the wire connector, the shift detector, and the guide are preferably provided in or on a common bracket. Accordingly, the common bracket eliminates the need to individually attach the wire connector, the shift detector, and the guide to the outboard motor, and the wire connector, the shift detector, and the guide are easily attached.

In a marine vessel including the guide, the drive position detector preferably includes a forward drive position detector to detect that the wire connector is located at a forward drive position, and a reverse drive position detector to detect that the wire connector is located at a reverse drive position. Furthermore, the neutral position detector is preferably provided in a vicinity of or adjacent to a center position of the guide corresponding to the neutral position, the forward drive position detector is preferably provided in a vicinity of or adjacent to a position on a first end side of the guide corresponding to the forward drive position, and the reverse drive position detector is preferably provided in a vicinity of or adjacent to a position on a second end side of the guide corresponding to the reverse drive position. Accordingly, the forward drive position detector, the reverse drive position detector, and the neutral position detector are provided at the positions of the guide that slides the wire connector, respectively, such that the shift state is switchable to the neutral state, the forward drive state, or the reverse drive state based on an operation on the mechanical remote control.

In a marine vessel including the shift detector that includes the neutral position detector and the drive position detector, the neutral position detector preferably includes a neutral switch and is preferably operable to detect that the wire connector is located at the neutral position by pressing of the neutral switch by the wire connector that has moved to the neutral position, and the drive position detector preferably includes a drive switch and is preferably operable to detect that the wire connector is located at the drive position by pressing of the drive switch by the wire connector that has moved to the drive position. Accordingly, the switch-type neutral position detector and drive position detector easily detect that the wire connector is located at the neutral position and the drive position.

In a marine vessel according to a preferred embodiment of the present invention, the outboard motor preferably further includes a cowling in an upper portion of an outboard motor main body, and the wire connector and the shift detector are preferably housed together with the controller inside the cowling. Accordingly, the wire connector, the shift detector, and the controller are located in the upper portion of the outboard motor main body that a service worker can reach relatively easily, and thus the mechanical remote control, the wire connector, the shift detector, and the controller are easily connected to each other.

In such a case, the outboard motor preferably further includes an engine housed inside the cowling, and the controller preferably includes an engine control unit configured or programmed to control driving of the engine. Accordingly, as compared with a case in which the controller is separate from the engine control unit, the device structure is simplified.

In a marine vessel according to a preferred embodiment of the present invention, the wire connector is preferably provided independently of the shift actuator and the shift shaft without being mechanically connected to the shift actuator and the shift shaft. Accordingly, the shift-by-wire outboard motor of the marine vessel is operated by the mechanical remote control without a conventional link mechanism that mechanically connects the wire connector to the shift actuator or the shift shaft.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

The structure of a marine vessel 100 including an outboard motor 101 according to preferred embodiments of the present invention is now described with reference to FIGS. 1 to 4.

In the figures, arrow FWD represents the forward movement direction of the marine vessel 100 (front side with reference to a hull 100*a*), and arrow BWD represents the reverse movement direction of the marine vessel 100 (rear side with reference to the hull 100*a*).

In the figures, arrow Z1 represents the upward direction of the marine vessel 100, and arrow Z2 represents the downward direction of the marine vessel 100.

Figure 1:
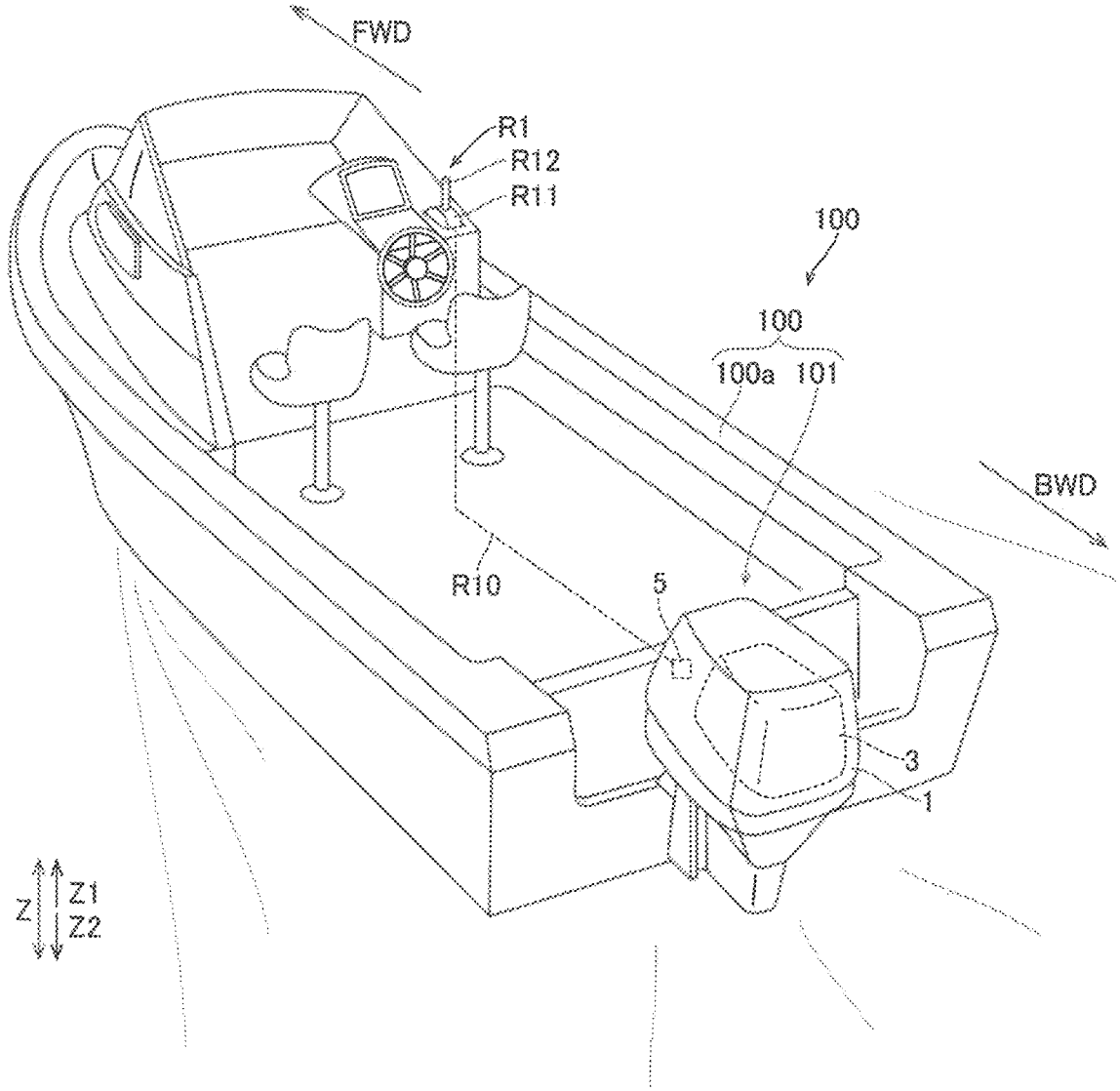
FIG. 1 is a perspective view showing a marine vessel including an outboard motor according to a preferred embodiment of the present invention.

As shown in FIG. 1, the marine vessel 100 includes the hull 100*a* including a mechanical remote control R1 and the outboard motor 101.

Figure 2:
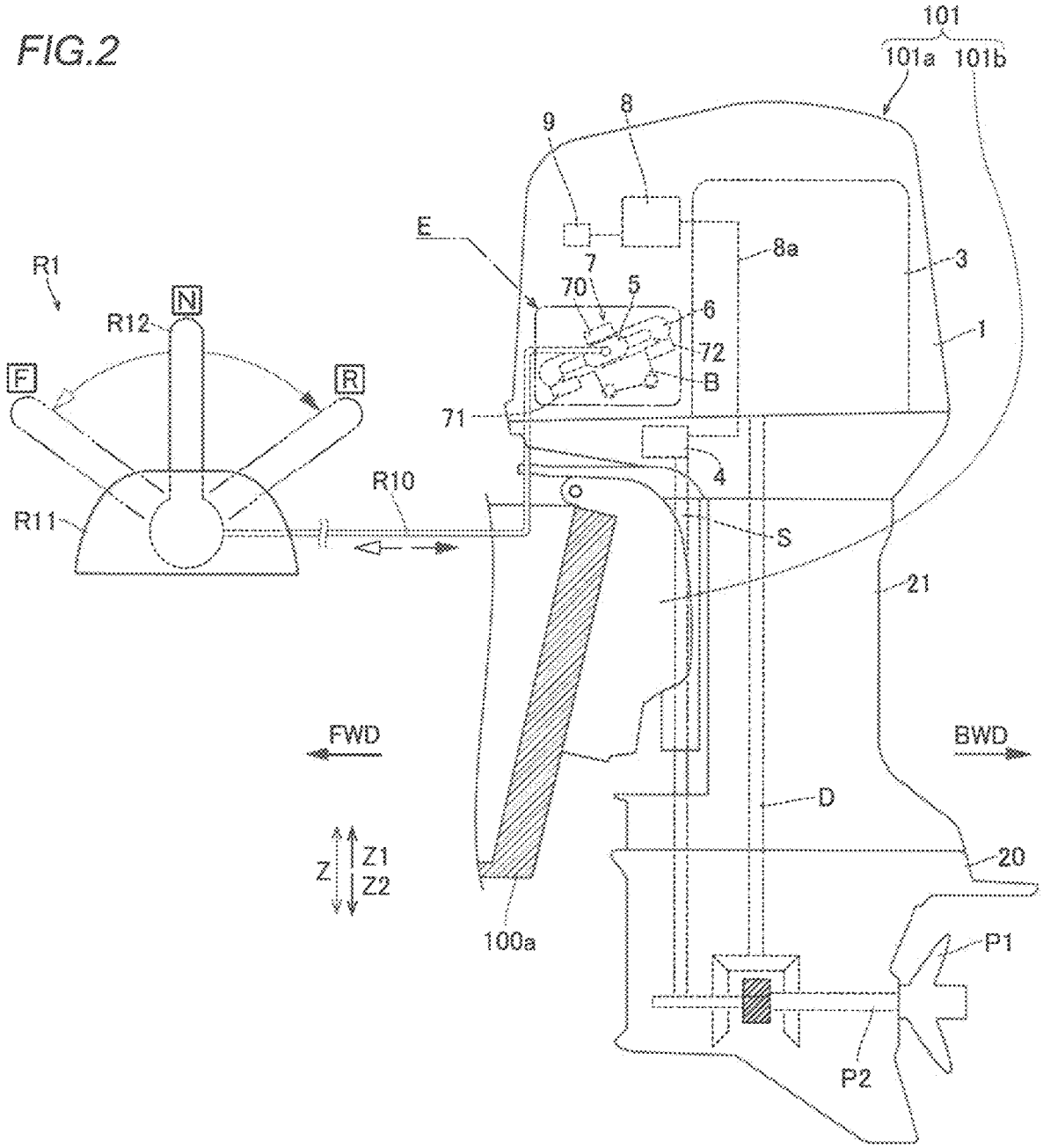
FIG. 2 is a side view showing an outboard motor according to a preferred embodiment of the present invention to which a mechanical remote control is connected.

As shown in FIG. 2, the mechanical remote control R1 includes a wire R10 and is mechanically connected to the outboard motor 101 by the wire R10. Specifically, a first end of the wire R10 is directly connected to a remote control main body R11, and a second end of the wire R10 is directly connected to a wire connector 5 of the outboard motor 101, which is described below. The wire R10 is not a signal line that transmits an electrical signal to the outboard motor 101, but mechanically transmits an operating force of the mechanical remote control R1 to the outboard motor 101.

The mechanical remote control R1 includes an operation lever R12 tilted to switch the shift state of the outboard motor 101. As an example, in the outboard motor 101, the shift state is in a neutral state when the operation lever R12 is non-tilted (i.e., upright), the shift state is in a forward drive state (forward state) when the operation lever R12 is tilted forward from the non-tilted position, and the shift state is in a reverse drive state (reverse state) when the operation lever R12 is tilted rearward from the non-tilted position. The forward drive state and the reverse drive state are examples of a "drive state".

The outboard motor 101 is not a mechanical outboard motor but a shift-by-wire (electric) outboard motor with respect to shift state switching. Specifically, the outboard motor 101 is not a mechanical outboard motor that drives a shift shaft S by a mechanical structure to switch the shift state, but a shift-by-wire (electric) outboard motor that drives the shift shaft S by a shift actuator 4 drivingly controlled by a controller 8 to switch the shift state.

Figure 3:
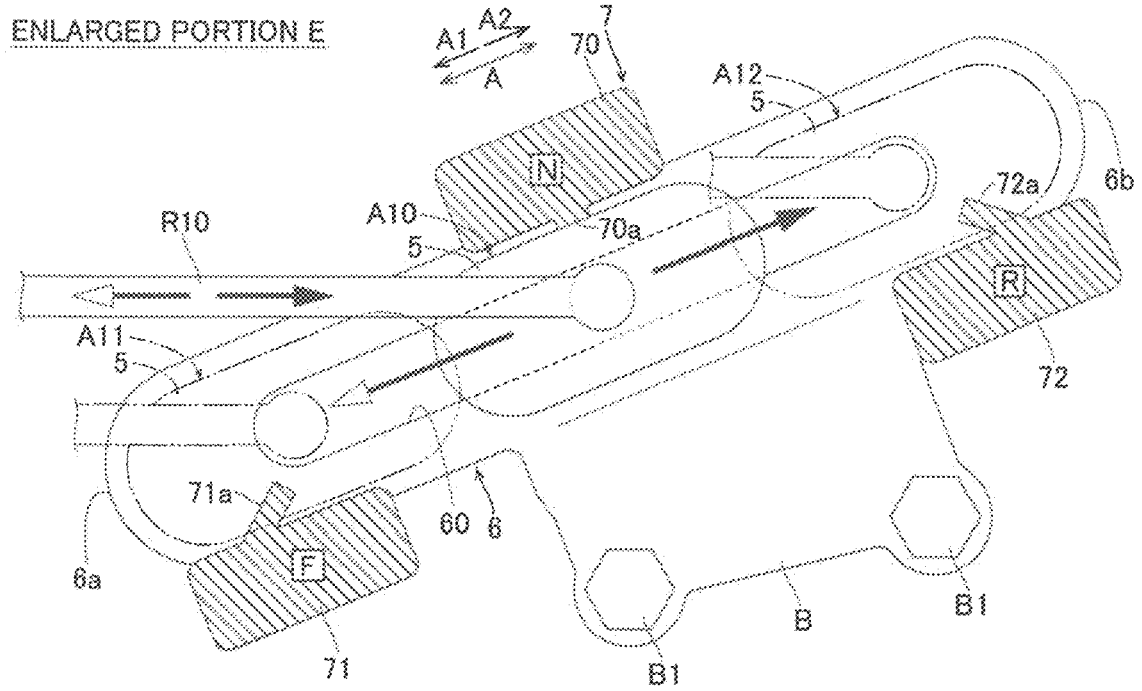
FIG. 3 is an enlarged view of a portion E in FIG. 2.
Figure 4:
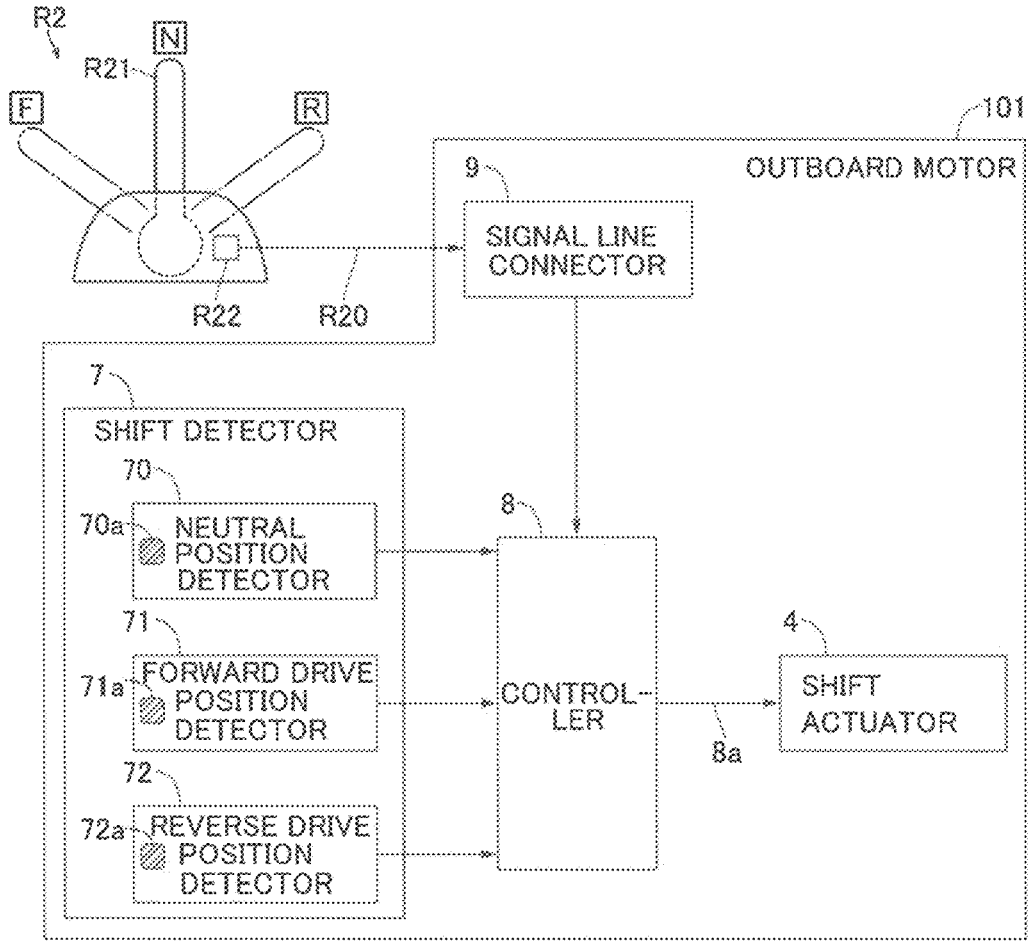
FIG. 4 is a control block diagram of an outboard motor and an electric (shift-by-wire) remote control according to a preferred embodiment of the present invention.

The outboard motor 101 is operated by either the mechanical remote control R1 or a shift-by-wire (electric) remote control R2 (see FIG. 4). FIGS. 1 to 3 show a state in which the mechanical remote control R1 is connected to the outboard motor 101. FIG. 4 shows a state in which the shift-by-wire (electric) remote control R2 is connected to the outboard motor 101.

As shown in FIG. 2, the outboard motor 101 includes an outboard motor main body 101*a* and a mounting bracket 101*b* to attach the outboard motor main body 101*a* to the hull 100*a*.

The outboard motor main body 101*a* includes a cowling 1, a lower case 20, an upper case 21, an engine 3, the shift actuator 4, the wire connector 5, a guide 6, a shift detector 7, the controller 8, and a signal line connector 9.

The operation lever R12 is tilted such that the wire connector 5 is mechanically moved along the guide 6 via the wire R10. The shift detector 7 includes three detectors including a neutral position detector 70, a forward drive position detector 71, and a reverse drive position detector 72, and the three detectors are provided at different positions of the guide 6. The forward drive position detector 71 and the reverse drive position detector 72 are examples of a "drive position detector".

The shift detector 7 (the neutral position detector 70, the forward drive position detector 71, and the reverse drive position detector 72) detects that the wire connector 5 has moved to a neutral position A10 (see FIG. 3) corresponding to the neutral state, a forward drive position A11 (see FIG. 3) corresponding to the forward drive state, or a reverse drive position A12 (see FIG. 3) corresponding to the reverse drive state. The forward drive position A11 and the reverse drive position A12 are examples of a "drive position".

The controller 8 performs a control to drive the shift actuator 4 to switch the shift state (to the neutral state, the forward drive state, or the reverse drive state) based on the detection result of the shift detector 7. The wire connector 5, the guide 6, and the shift detector 7 are described below in detail.

The cowling 1 is located in an upper portion of the outboard motor main body 101*a* when the marine vessel 100 is propelled by a propeller P1. The engine 3, which is a drive source of the outboard motor 101, is housed inside the cowling 1. A first end of a drive shaft D is connected to a crankshaft (not shown) of the engine 3. A second end of the drive shaft D is located in the lower case 20.

The wire connector 5, the shift detector 7, and the guide 6 are located together with the controller 8 inside the cowling 1. The wire connector 5, the shift detector 7, and the guide 6 are located in front of the engine 3 inside the cowling 1. That is, the wire connector 5, the shift detector 7, and the guide 6 are located on the side close to the hull 100*a* inside the cowling 1.

The lower case 20 is located in a lower portion of the outboard motor main body 101*a* when the marine vessel 100 is propelled by the propeller P1. A propeller shaft P2 and the propeller P1 are provided in and on the lower case 20, respectively.

The upper case 21 is located between the cowling 1 and the lower case 20. The upper case 21 is supported by the mounting bracket 101*b* via a mount (not shown).

The shift actuator 4 drives the shift shaft S to switch the shift state. The expression "switch the shift state" indicates switching the transmission state of a driving force from the drive shaft D to the propeller shaft P2. The shift actuator 4 drives the shift shaft S to switch the shift state to the neutral state, the forward drive state, or the reverse drive state.

The "neutral state" refers to a state in which a driving force is not transmitted from the drive shaft D to the propeller shaft P2. The "forward drive state" refers to a state in which the propeller shaft P2 is rotated in a predetermined direction by the drive shaft D. The "reverse drive state" refers to a state in which the propeller shaft P2 is rotated in a direction opposite to the predetermined direction by the drive shaft D.

The shift actuator 4 is connected to the controller 8 via a signal line 8*a*. The shift actuator 4 is drivingly controlled by receiving a control signal from the controller 8 via the signal line 8*a*. The shift actuator 4 includes an electric motor drivingly controlled by the controller 8. The shift actuator 4 is located inside the upper case 21 or the cowling 1.

The wire R10 of the mechanical remote control R1 is connected to the wire connector 5, and the wire connector 5 is moved by the wire R10. That is, the operation lever R12 of the mechanical remote control R1 is tilted such that the wire connector 5 is mechanically moved via the wire R10. The wire connector 5 is engaged with the guide 6, and movement of the wire connector 5 is guided by the guide 6.

In FIG. 3, the moving direction of the wire connector 5 is indicated by an A direction, a direction from the reverse drive position A12 toward the forward drive position A11 is indicated by an A1 direction, and the opposite direction is indicated by an A2 direction.

The guide 6 includes a guide hole 60, and the wire connector 5 is engaged with the guide 6 by inserting a portion (not shown) of the wire connector 5 into the guide hole 60. The guide 6 and the guide hole 60 have an elongated shape (elongated oval shape) extending in the A direction.

The wire connector 5 is provided independently of the shift actuator 4 and the shift shaft S without being mechanically connected to the shift actuator 4 (see FIG. 2) and the shift shaft S (see FIG. 2). That is, the wire connector 5 is not connected to the shift actuator 4 and the shift shaft S by a mechanical power transmission mechanism such as a link mechanism.

The guide 6 guides and slides the wire connector 5 between the neutral position A10, the forward drive position A11, and the reverse drive position A12. That is, the guide 6 reciprocates the wire connector 5 linearly along the elongated guide 6.

The "neutral position A10" refers to a predetermined position of the guide 6 at which the shift state is changed to the neutral state. When the wire connector 5 is located at the neutral position A10, a neutral switch 70*a* described below of the neutral position detector 70 is pressed by the wire connector 5, and the shift state is changed to the neutral state. A position in the vicinity of or adjacent to a center position of the elongated guide 6 corresponds to the neutral position A10.

The "forward drive position A11" refers to a predetermined position of the guide 6 at which the shift state is changed to the forward drive state. The wire connector 5 moves from the neutral position A10 in the A1 direction to the forward drive position A11. When the wire connector 5 is located at the forward drive position A11, a forward drive switch 71*a* described below of the forward drive position detector 71 is pressed by the wire connector 5, and the shift state is changed to the forward drive state. A position in the vicinity of or adjacent to a position on the first end 6*a* side of the elongated guide 6 corresponds to the forward drive position A11.

The "reverse drive position A12" refers to a predetermined position of the guide 6 at which the shift state is changed to the reverse drive state. The wire connector 5 moves from the neutral position A10 in the A2 direction to the reverse drive position A12. When the wire connector 5 is located at the reverse drive position A12, a reverse drive switch 72*a* described below of the reverse drive position detector 72 is pressed by the wire connector 5, and the shift state is changed to the reverse drive state. A position in the vicinity of or adjacent to a position on the second end 6*b* side of the elongated guide 6 corresponds to the reverse drive position A12.

The neutral position detector 70 is provided in the vicinity of or adjacent to the center position of the guide 6 corresponding to the neutral position A10. The forward drive position detector 71 is provided in the vicinity of or adjacent to the position on the first end 6*a* side of the guide 6 corresponding to the forward drive position A11. The reverse drive position detector 72 is provided in the vicinity of or adjacent to the position on the second end 6*b* side of the guide 6 corresponding to the reverse drive position A12.

The neutral position detector 70 includes the neutral switch 70*a*. The neutral switch 70*a* is pressed by the wire connector 5 that has moved to the neutral position A10 such that the neutral position detector 70 detects that the wire connector 5 is located at the neutral position A10. When the neutral switch 70*a* is pressed by the wire connector 5, the operation lever R12 is non-tilted (upright).

The forward drive position detector 71 includes the forward drive switch 71*a*. The forward drive switch 71*a* is pressed by the wire connector 5 that has moved to the forward drive position A11 such that the forward drive position detector 71 detects that the wire connector 5 is located at the forward drive position A11. When the forward drive switch 71*a* is pressed by the wire connector 5, the operation lever R12 is tilted forward.

The reverse drive position detector 72 includes the reverse drive switch 72*a*. The reverse drive switch 72*a* is pressed by the wire connector 5 that has moved to the reverse drive position A12 such that the reverse drive position detector 72 detects that the wire connector 5 is located at the reverse drive position A12. When the reverse drive switch 72*a* is pressed by the wire connector 5, the operation lever R12 is tilted rearward.

The wire connector 5, the shift detector 7, and the guide 6 are provided in or on a common bracket B. That is, the wire connector 5, the shift detector 7, and the guide 6 are integrally attached to the outboard motor 101 by the bracket B. As an example, the bracket B is fixed to the inside of the cowling 1 by fasteners B1 such as bolts.

The controller 8 includes an engine control unit that controls driving of the engine 3. As an example, the controller 8 includes a computer including a central processing unit (CPU), a read-only memory (ROM), a random access memory (RAM), etc.

The controller 8 performs a control to drive the shift actuator 4 to switch the shift state (to the neutral state, the forward drive state, or the reverse drive state) based on the detection result of the shift detector 7. That is, the controller 8 performs a control to implement the shift-by-wire of the outboard motor 101.

As shown in FIG. 4, a first end of a signal line R20 of the shift-by-wire (electric) remote control R2 that inputs an electrical signal to the controller 8 to switch the shift state is connectable to the signal line connector 9. The shift-by-wire remote control R2 includes an operation lever R21 that is tilted and a lever position sensor (angle sensor) R22 that detects the tilt angle of the operation lever R21. A second end of the signal line R20 is connected to the lever position sensor (angle sensor) R22.

The signal line connector 9 may be connected to the controller 8 via a signal line, or may be provided directly on the controller 8. One of the mechanical remote control R1 and the electric remote control R2 is connected to the outboard motor 101. Both the mechanical remote control R1 and the electric remote control R2 may be connected to the outboard motor 101.

According to the various preferred embodiments of the present invention described above, the following advantageous effects are achieved.

According to a preferred embodiment of the present invention, the outboard motor 101 includes the shift detector 7 to detect that the wire connector 5 to which the wire R10 of the mechanical remote control R1 is connected and that is moved by the wire R10 has moved to the neutral position A10 corresponding to the shift state of the neutral state or the drive position (the forward drive position A11 or the reverse drive position A12) corresponding to the shift state of the drive state, and the controller 8 configured or programmed to perform a control to drive the shift actuator 4 to switch the shift state to the neutral state or the drive state based on the detection result of the shift detector 7. Accordingly, the controller 8 uses the wire connector 5 and the shift detector 7, which are elements of the outboard motor 101, to detect movement of the wire connector 5 to the neutral position A10 or the drive position in response to movement of the wire R10 connected to the mechanical remote control R1 so as to acquire the detection result (electrical signal) to switch the shift state to the neutral state or the drive state. Therefore, the wire R10 of the mechanical remote control R1 is directly connected to the outboard motor 101. That is, the shift-by-wire outboard motor 101 is operated by the mechanical remote control R1 without providing, on the hull 100*a*, a device that outputs an electrical signal to the controller 8 of the outboard motor 101 in response to movement of the wire R10 connected to the mechanical remote control R1.

According to a preferred embodiment of the present invention, the shift detector 7 includes the neutral position detector 70 to detect that the wire connector 5 is located at the neutral position A10, and the drive position detector (the forward drive position detector 71 or the reverse drive position detector 72) to detect that the wire connector 5 is located at the drive position (the forward drive position A11 or the reverse drive position A12). Accordingly, each of the neutral position A10 and the drive position is detected by the dedicated detector, and thus it is accurately detected that the wire connector 5 is located at the neutral position A10 or the drive position.

According to a preferred embodiment of the present invention, the outboard motor 101 further includes the guide 6 to guide the wire connector 5 between the neutral position A10 and the drive position (the forward drive position A11 or the reverse drive position A12) and slide the wire connector 5. Accordingly, the guide 6 easily converts a force applied from the wire R10 to the wire connector 5 into sliding of the wire connector 5.

According to a preferred embodiment of the present invention, the wire connector 5, the shift detector 7, and the guide 6 are provided in or on the common bracket B. Accordingly, the common bracket B eliminates the need to individually attach the wire connector 5, the shift detector 7, and the guide 6 to the outboard motor 101, and the wire connector 5, the shift detector 7, and the guide 6 are easily attached.

According to a preferred embodiment of the present invention, the drive position detector includes the forward drive position detector 71 to detect that the wire connector 5 is located at the forward drive position A11, and the reverse drive position detector 72 to detect that the wire connector 5 is located at the reverse drive position A12. Furthermore, the neutral position detector 70 is provided in the vicinity of or adjacent to the center position of the guide 6 corresponding to the neutral position A10, the forward drive position detector 71 is provided in the vicinity of or adjacent to the position on the first end 6*a* side of the guide 6 corresponding to the forward drive position A11, and the reverse drive position detector 72 is provided in the vicinity of or adjacent to the position on the second end 6*b* side of the guide 6 corresponding to the reverse drive position A12. Accordingly, the forward drive position detector 71, the reverse drive position detector 72, and the neutral position detector 70 are provided at the positions of the guide 6 that slides the wire connector 5, respectively, such that the shift state is switchable to the neutral state, the forward drive state, or the reverse drive state based on an operation on the mechanical remote control R1.

According to a preferred embodiment of the present invention, the neutral position detector 70 includes the neutral switch 70*a* and detects that the wire connector 5 is located at the neutral position A10 by pressing of the neutral switch 70*a* by the wire connector 5 that has moved to the neutral position A10. Furthermore, the drive position detector includes the drive switch (the forward drive switch 71*a* or the reverse drive switch 72*a*) and detects that the wire connector 5 is located at the drive position by pressing of the drive switch by the wire connector 5 that has moved to the drive position (the forward drive position A11 or the reverse drive position A12). Accordingly, the switch-type neutral position detector 70 and drive position detector easily detect that the wire connector 5 is located at the neutral position A10 and the drive position.

According to a preferred embodiment of the present invention, the outboard motor 101 further includes the cowling 1 in the upper portion of the outboard motor main body 101*a*, and the wire connector 5 and the shift detector 7 are housed together with the controller 8 inside the cowling 1. Accordingly, the wire connector 5, the shift detector 7, and the controller 8 are located in the upper portion of the outboard motor main body 101*a* that a service worker can reach relatively easily, and thus the mechanical remote control R1, the wire connector 5, the shift detector 7, and the controller 8 are easily connected to each other.

According to a preferred embodiment of the present invention, the outboard motor 101 further includes the engine 3 housed inside the cowling 1, and the controller 8 includes the engine control unit configured or programmed to control driving of the engine 3. Accordingly, as compared with a case in which the controller 8 is separate from the engine control unit, the device structure is simplified.

According to a preferred embodiment of the present invention, the wire connector 5 is provided independently of the shift actuator 4 and the shift shaft S without being mechanically connected to the shift actuator 4 and the shift shaft S. Accordingly, the shift-by-wire outboard motor 101 is operated by the mechanical remote control R1 without a conventional link mechanism that mechanically connects the wire connector 5 to the shift actuator 4 or the shift shaft S.

According to a preferred embodiment of the present invention, the shift actuator 4 includes the electric motor drivingly controlled by the controller 8. Accordingly, the shift shaft S is driven by the electric motor drivingly controlled by the engine control unit.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

Figure 5:
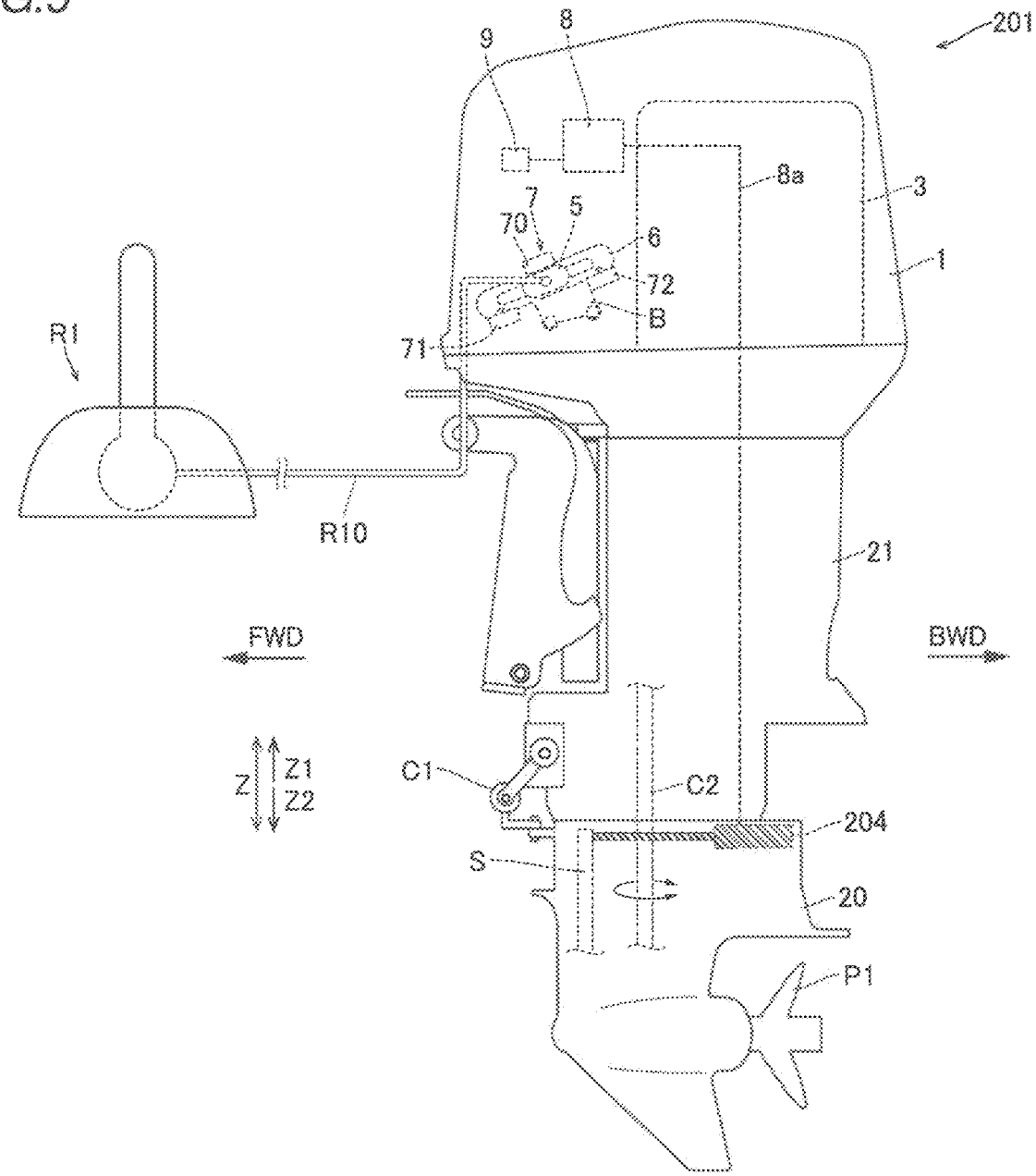
FIG. 5 is a side view showing an outboard motor according to a modified example to which a mechanical remote control is connected.

For example, while the shift actuator is preferably provided in the upper case in preferred embodiments described above, the present invention is not restricted to this. In a preferred embodiment of the present invention, as in an outboard motor 201 according to a modified example shown in FIG. 5, a shift actuator 204 may be provided in a lower case 20. In such a case, the shift actuator 204 is connected to a controller 8 by a signal line 8*a*. The outboard motor 201 includes a steering actuator C1 and a steering shaft C2 extending across an upper case 21 and the lower case 20. The steering actuator C1 rotates the lower case 20 with respect to the upper case 21 with the steering shaft C2 as the center of rotation. The shift actuator is not limited to the arrangement of the outboard motor in preferred embodiments described above and the arrangement of the outboard motor shown in FIG. 5, but may be provided at any position of the outboard motor.

While the shift detector preferably includes three switch-type detectors (i.e., the neutral position detector, the forward drive position detector, and the reverse drive position detector) in preferred embodiments described above, the present invention is not restricted to this. In a preferred embodiment of the present invention, the shift detector may alternatively include three detectors that electrically detect contact with the wire connector, for example. Furthermore, the shift detector may alternatively include one detector that measures a distance from the movable wire connector. In such a case, the controller determines the shift state based on the distance between the detector and the wire connector detected by the detector. Thus, the shift detector may be any type of detector as long as the same electrically detects the position of the wire connector moved by the wire.

While the marine vessel preferably includes one outboard motor in preferred embodiments described above, the present invention is not restricted to this. In a preferred embodiment of the present invention, the marine vessel may alternatively include a plurality of outboard motors.

While the shift actuator preferably includes the electric motor in preferred embodiments described above, the present invention is not restricted to this. In a preferred embodiment of the present invention, the shift actuator may alternatively include a drive device other than the electric motor such as an electrically driven cylinder.

While the controller preferably includes the engine control unit in preferred embodiments described above, the present invention is not restricted to this. In a preferred embodiment of the present invention, the controller may alternatively include a control unit communicable with the engine control unit.

While the outboard motor preferably includes the signal line connector in preferred embodiments described above, the present invention is not restricted to this. In a preferred embodiment of the present invention, the outboard motor may not include the signal line connector.

While the wire connector and the shift detector are preferably located inside the cowling in preferred embodiments described above, the present invention is not restricted to this. In a preferred embodiment of the present invention, the wire connector and the shift detector may alternatively be located inside the upper case or the lower case.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a shift actuator to drive a shift shaft to switch a shift state of the outboard motor;

a wire connector to allow a wire of a mechanical remote control to be connected thereto and operable to be moved by the wire;

a shift detector to detect that the wire connector has moved to a neutral position corresponding to the shift state of a neutral state or a drive position corresponding to the shift state of a drive state; and a controller configured or programmed to perform a control to drive the shift actuator to switch the shift state to the neutral state or the drive state based on a detection result of the shift detector.

2. The outboard motor according to claim 1, wherein the shift detector includes:

a neutral position detector to detect that the wire connector is located at the neutral position; and a drive position detector to detect that the wire connector is located at the drive position.

3. The outboard motor according to claim 2, further comprising:

a guide to guide the wire connector between the neutral position and the drive position and slide the wire connector.

4. The outboard motor according to claim 3, wherein the wire connector, the shift detector, and the guide are provided in or on a common bracket.

5. The outboard motor according to claim 3, wherein the drive position detector includes:

a forward drive position detector to detect that the wire connector is located at a forward drive position; and a reverse drive position detector to detect that the wire connector is located at a reverse drive position;

the neutral position detector is provided in a vicinity of or adjacent to a center position of the guide corresponding to the neutral position;

the forward drive position detector is provided in a vicinity of or adjacent to a position on a first end side of the guide corresponding to the forward drive position; and the reverse drive position detector is provided in a vicinity of or adjacent to a position on a second end side of the guide corresponding to the reverse drive position.

6. The outboard motor according to claim 2, wherein the neutral position detector includes a neutral switch and is operable to detect that the wire connector is located at the neutral position by pressing of the neutral switch by the wire connector that has moved to the neutral position; and the drive position detector includes a drive switch and is operable to detect that the wire connector is located at the drive position by pressing of the drive switch by the wire connector that has moved to the drive position.

7. The outboard motor according to claim 1, further comprising:

a cowling in an upper portion of an outboard motor main body; wherein the wire connector and the shift detector are housed together with the controller inside the cowling.

8. The outboard motor according to claim 7, further comprising:

an engine housed inside the cowling; wherein the controller includes an engine control unit configured or programmed to control driving of the engine.

9. The outboard motor according to claim 1, wherein the wire connector is provided independently of the shift actuator and the shift shaft without being mechanically connected to the shift actuator and the shift shaft.

10. The outboard motor according to claim 1, wherein the shift actuator includes an electric motor drivingly controlled by the controller.

11. The outboard motor according to claim 1, further comprising:

a cowling in an upper portion of an outboard motor main body;

a lower case in a lower portion of the outboard motor main body; and an upper case between the cowling and the lower case; wherein the shift actuator is provided in the lower case.

12. A marine vessel comprising:

a hull including a mechanical remote control; and an outboard motor mounted on the hull; wherein the outboard motor includes:

a shift actuator to drive a shift shaft to switch a shift state of the outboard motor;

a wire connector to allow a wire of the mechanical remote control to be connected thereto and operable to be moved by the wire;

a shift detector to detect that the wire connector has moved to a neutral position corresponding to the shift state of a neutral state or a drive position corresponding to the shift state of a drive state; and a controller configured or programmed to perform a control to drive the shift actuator to switch the shift state to the neutral state or the drive state based on a detection result of the shift detector.

13. The marine vessel according to claim 12, wherein the shift detector includes:

a neutral position detector to detect that the wire connector is located at the neutral position; and a drive position detector to detect that the wire connector is located at the drive position.

14. The marine vessel according to claim 13, wherein the outboard motor further includes a guide to guide the wire connector between the neutral position and the drive position and slide the wire connector.

15. The marine vessel according to claim 14, wherein the wire connector, the shift detector, and the guide are provided in or on a common bracket.

16. The marine vessel according to claim 14, wherein the drive position detector includes:

a forward drive position detector to detect that the wire connector is located at a forward drive position; and a reverse drive position detector to detect that the wire connector is located at a reverse drive position;

the neutral position detector is provided in a vicinity of or adjacent to a center position of the guide corresponding to the neutral position;

the forward drive position detector is provided in a vicinity of or adjacent to a position on a first end side of the guide corresponding to the forward drive position; and the reverse drive position detector is provided in a vicinity of or adjacent to a position on a second end side of the guide corresponding to the reverse drive position.

17. The marine vessel according to claim 13, wherein the neutral position detector includes a neutral switch and is operable to detect that the wire connector is located at the neutral position by pressing of the neutral switch by the wire connector that has moved to the neutral position; and the drive position detector includes a drive switch and is operable to detect that the wire connector is located at the drive position by pressing of the drive switch by the wire connector that has moved to the drive position.

18. The marine vessel according to claim 12, wherein the outboard motor further includes a cowling in an upper portion of an outboard motor main body; and the wire connector and the shift detector are housed together with the controller inside the cowling.

19. The marine vessel according to claim 18, wherein the outboard motor further includes an engine housed inside the cowling; and the controller includes an engine control unit configured or programmed to control driving of the engine.

20. The marine vessel according to claim 12, wherein the wire connector is provided independently of the shift actuator and the shift shaft without being mechanically connected to the shift actuator and the shift shaft.

* * * * *